US005960697A

United States Patent [19]

Hayase et al.

[11] Patent Number: 5,960,697

[45] Date of Patent: Oct. 5, 1999

[54] AXIAL PISTON MACHINE

[75] Inventors: Isao Hayase, Tsuchiura; Shunichi Mitsuya; Takeshi Tsuchiya, both of Chiyoda-machi; Yuzo Kadomukai, Ishioka; Yukio Takahashi, Hitachinaka, all of Japan

[73] Assignee: Hitachi, Ltd., Tokyo, Japan

[21] Appl. No.: 09/030,884

[22] Filed: Feb. 26, 1998

[30] Foreign Application Priority Data

Feb. 26, 1997 [JP] Japan ..... 9-042009

[51] Int. Cl.[6] ..... F01B 13/04

[52] U.S. Cl. ..... 92/12.2; 92/57; 92/71; 417/269

[58] Field of Search ..... 417/269; 92/12.2, 92/71, 57

[56] References Cited

U.S. PATENT DOCUMENTS

| | | | |
|---|---|---|---|
| 4,301,716 | 11/1981 | Saegusa et al. | 417/269 X |
| 4,815,327 | 3/1989 | Drevet | 417/269 X |
| 5,735,172 | 4/1998 | Parker | 417/269 X |
| 5,845,559 | 12/1998 | Schroeder et al. | 417/269 X |

OTHER PUBLICATIONS

Mechanical Engineer's Handbook, Japan Association of Mechanical Engineers, 1991, 5 pages.

*Primary Examiner*—Hoang Nguyen

*Attorney, Agent, or Firm*—Evenson, McKeown, Edwards & Lenahan, P.L.L.C.

[57] ABSTRACT

An axial piston machine comprises first and second members arranged so that one of the first and second members is swingable relative to the other to provide relative swinging motion, a plurality of pistons inserted in a plurality of cylinders formed in the second member, respectively, the pistons being mechanically engaged with the first member so that the relative swinging motion reciprocates the plurality of pistons in the cylinders, and a swinging mechanism for swinging the above-mentioned one of the first and second members relative to the other, and the axial piston machine is characterized in that the first and second members have spherical portions providing a coupling portion binding one of the first and second members to a spherical point of the other to be universally rotatable about the point, and the above-mentioned swinging mechanism comprises a relative revolving mechanism for revolving at least one of the first and second members relative to the other to provide a relative swinging motion between the first member and the second member, thereby to reciprocate the pistons.

16 Claims, 5 Drawing Sheets

AXIAL PISTON MACHINE

BACKGROUND OF THE INVENTION

This application claims the priority of Japanese application No. 9-042009, filed Feb. 26, 1997, the disclosure of which is expressly incorporated by reference herein.

The present invention relates to an axial piston displacement type machine having pistons arranged so as to reciprocate in a drive shaft direction and, more particularly, to an axial piston type liquid pump suitable for pressurizing and transporting liquid and an axial piston type liquid motor for driving an output shaft by a pressurized liquid.

An example of conventional axial piston displacement type machines is disclosed in MECHANICAL ENGINEER'S HANDBOOK edited by Japan Association of Mechanical Engineers (1991), B 5, FLUID MACHINE, Page 188 FIG. 420(*c*), which is a swash plate type liquid pump. The swash plate type liquid pump comprises a fixed cylinder block having a plurality of pistons inserted in cylinders formed therein, a swinging plate linked with the pistons and prevented from rotating by a rotation preventing mechanism (not shown) and a swash plate which is arranged between the swinging plate and a fixed frame (not shown) and in contact with the swinging plate through bearings therebetween. Rotation of the swash plate swings the swinging plate, and the swinging motion of the swinging plate reciprocates each of the pistons in the cylinders.

Other examples of the conventional axial piston displacement type machines are disclosed in MECHANICAL ENGINEERING HANDBOOK B 5, FLUID MACHINE, Page 188 FIG. 420(*a*) and Page 191 FIG. 441, one of which is a bent axis type axial piston liquid pump and the other is a bent axis type axial piston liquid motor. The pump or motor comprises a cylinder block having a plurality of pistons inserted in cylinders formed therein, an input or output shaft the axis of which is inclined against the axis of the cylinder block and which is linked to the pistons, a rotation synchronizing mechanism connecting the shaft and the cylinder block to allow them to rotate in synchronism with each other and a frame (not shown) rotatably supporting the shaft and the cylinder block so that they are able to rotate about their axes, respectively. In the pump as shown in FIG. 430(*a*), rotation of the input shaft rotates the cylinder block and reciprocates the pistons in the cylinders and in the fluid motor as shown in FIG. 441, fluid supplied into the cylinders by operation of valves reciprocates the pistons and the reciprocation of the pistons rotates the output shaft.

In the above-mentioned conventional swash plate type liquid pump, the swinging plate and the frame do not rotate, however, the swash plate incorporated between the swinging plate and the frame rotates, so that two rotation-sliding portions exist at which the swash plate slides at a relatively large sliding speed under a relatively large load due to hydraulic pressure applied by pumping.

Further, in the above-mentioned conventional bent axis type axial piston liquid pump or motor, the frame which does not rotate and an flange portion of the input or output shaft which rotates slide at a relatively large sliding speed under a relatively large thrust load due to liquid pressure applied on the piston head.

Further, in a case where an opening area of each cylinder at a side of the valve plate is smaller than the cross-sectional area of each piston, a thrust load occurring in the cylinder block according to the difference in liquid pressure receiving area acts on the valve plate. The thrust load is relatively large and the cylinder block slides on the valve plate at a relative large sliding speed with such a relatively large thrust load.

The above-mentioned conventional swash plate type liquid pump, the bent axis type liquid pump and bent axis type liquid motor each have a common structure in which first and second members are arranged which do not effect relative rotating motion and effect only relative swinging motion according to rotation of the input or output shaft, the first member is engaged with a plurality of pistons at positions around an axis thereof, the second member has a plurality of cylinders formed therein nearly in parallel to and around an axis thereof and the pistons are slidably inserted in the cylinders to form a plurality of working chambers, respectively. In this construction, the rotation of the input or output shaft, the relative swinging motion of the first and second members and the reciprocation of the pistons are linked, whereby the fluid is pressurized or transported by driving the output shaft to rotate, or, on the contrary, the output shaft is driven by supplying a controlled pressurized fluid into the working chambers.

For example, in the conventional swash plate type liquid pump, the swinging plate is the first member, and the second member is a fixed member such as the cylinder block to which the frame and a cylinder head are fixed.

Both of the swinging plate and the cylinder block do not effect a relative rotation because of the rotation preventing mechanism provided for the swinging plate, but effect the relative swinging motion which is imparted to the swinging plate by the rotation of the swash plate caused by rotation of the input shaft integrated with the swash plate.

The rotation of the swash plate, caused by rotation of the input shaft swings the swinging plate relative to the cylinder block, and the swinging motion reciprocates the pistons, whereby the volume of each working chamber is changed to pressurize and transport the fluid.

On the other hand, in the other conventional bent axis type fluid pump or fluid motor, the input or output shaft having a flange is the above-mentioned first member, and the cylinder block is the second member. Since both of them rotate together by the rotation synchronizing mechanism, they do not effect relative rotating motion, but effect relative swinging motion because the first and second members have the axes inclined to each other and rotate about the axes in synchronism with each other, respectively.

The plurality of pistons linked to a flange portion of the input or output shaft which is the first member through rods are slidably inserted in the cylinders formed in the cylinder block which is the second member around the axis of the cylinder block nearly in parallel to the axis to form a plurality of working chambers, respectively.

The rotation of the input or output shaft, the relative swinging motion between the flange of the shaft and the cylinder block and the reciprocating motion to increase or decrease the volume of each working chamber are linked, so that the bent axis type axial piston fluid pump pressurizes and transports the fluid by driving the input shaft to rotate and the bent axis type axial piston fluid motor supplys a controlled pressurized fluid into the working chambers to drive the output shaft to rotate.

As mentioned above, in the conventional axial piston displacement type machines, a rotation-sliding portion at which a sliding load and a sliding speed each are large exists at a portion that bears the thrust force. In a case where a slide bearing is provided for the rotation-sliding portion, there has been such a technical problem that the efficiency of the machine decreases due to a mechanical friction loss and the reliability also decreases because of occurrence of seizure.

On the other hand, in a case where a thrust roll bearing which has a relatively small frictional resistance is incorporated for the rotation-sliding portion, the above-mentioned decrease in efficiency and reliability can be improved to some extent, however, there has been still left such a problem to be improved that the roll bearing is restricted in making the life long because metal fatigue progresses and it also raises the cost because the number of parts increases.

SUMMARY OF THE INVENTION

An object of the present invention is to provide an axial piston machine in which a mechanical friction loss and friction heat generation, caused by a load applied in a thrust direction can be reduced and the number of machine parts is reduced.

In order to achieve the above-mentioned object, according to the present invention, an axial piston machine is provided, which comprises first and second members arranged so that one of the first and second members is swingable relative to the other to provide relative swinging motion, a plurality of pistons inserted in a plurality of cylinders formed in the second member, respectively, the pistons being mechanically engaged with the first member so that the relative swinging motion reciprocates the plurality of pistons in the cylinders, and a swinging mechanism for swinging the above-mentioned one of the first and second members relative to the other, and which is characterized in that the first and second members have a coupling portion formed thereby and binding one of the first and second members to a point of the other to be universally rotatable about the point, and the above-mentioned swinging mechanism comprises a relative revolving mechanism for revolving at least one of the first and second members relative to the other to provide a relative swinging motion between the first member and the second member, thereby to reciprocate the pistons.

The coupling portion comprises preferably spherical portions formed in the first and second members, respectively, so as to form a spherical abutment along which one of said first and second members is slidably movable on the other about the above-mentioned point.

The engagement between the first member and the pistons included mechanical linking therebetween using piston rods, contact therebetween using slide shoes, etc.

The above-mentioned machine can be completed by a single piston and a construction corresponding thereto instead of the plurality of pistons.

An aspect of the present invention is an axial piston machine which comprises a lever having an axis, the lever including a spherical portion having a spherical surface of which a spherical center is on the axis of the lever and a shaft portion axially extending from the spherical surface in a direction opposite to the spherical center, a plurality of pistons each linked with the lever at an opposite side to the spherical surface of the lever, a fixed member having an axis and comprising a plurality of cylinders formed therein and separated from the axis and from each other, a spherical support portion having spherical center on the axis of the lever and slidably supporting the spherical portion of the lever to form a spherical abutment, and a bearing portion surrounding the shaft portion of the lever, the plurality of pistons being slidably inserted in the cylinders, respectively, and a rotating member, rotatably inserted in the bearing portion of the fixed member, and rotatably and slidably engaged with the shaft portion of the lever so that the rotation axis of the rotating member is eccentric to the axis of the shaft portion of said lever, whereby rotation of the rotating member causes swinging motion of the spherical portion relative to the fixed member and the swinging motion of the spherical portion of the lever reciprocates the pistons.

A further feature of the present invention is that an engaging portion of the rotating member and the shaft portion of the lever is constructed so that an inclination angle between the rotation axis of the rotating member and the axis of the shaft portion of the lever is changeable.

Another feature of the present invention is that axial shift of the above-mentioned engaging portion changes the inclination angle between the rotation axis of the rotating member and the axis of the shaft portion of the lever, thereby to change strokes in the reciprocating motion of the pistons linked to the lever.

Another feature of the present invention is that a rotation preventing mechanism is mounted on the above-mentioned fixed member for preventing the lever from continuously rotating.

Another aspect of the present invention is an axial piston machine comprising first and second rotating members having axes inclined to each other to be rotatable about the axes, the second rotating member having a plurality of cylinders formed therein in parallel to the axis thereof and separated from the axis and from one another, a plurality of pistons inserted in the cylinders, respectively, and mechanically linked to the first rotating member, a mechanism for swinging one of the first and second rotating members relative to the other so as to reciprocate the plurality of pistons in the cylinders, and wherein the first and second rotating members have a spherical portion and a spherical support portion, respectively, to provide a spherical abutment along which the first and second rotating members are relatively slidable to each other, each of the spherical support portion and the spherical portion having a spherical center at a cross point of the axes of the first and second rotating members, the second rotating member supporting the first rotating member in a direction of the axis of the second member, and the mechanism for generating relative swinging motion comprises a rotation input shaft for rotating the first and second rotating members about their axes, and a fixed member for rotatably supporting the first rotating member so as to keep the inclination angle constant while allowing the first rotating member to rotate, whereby the first rotating member slides on the second rotating member along the spherical abutment and swings relatively to the second rotating member.

Another feature of the present invention is that a rotation-synchronizing mechanism is incorporated for synchronizing the rotation of the first rotating member with the rotation of the second rotating member.

According to the present invention, in order to effect the relative swinging motion one of the first and second members to the other, the first and second members are coupled to form the above-mentioned spherical abutment. The first and second members are constructed so that a portion of the first member separated from a spherical center of the spherical abutment revolves or orbits about the axis of the second member.

Further, the above-mentioned lever which is constructed so as to be swung by rotating the rotating member has the spherical portion and the shaft portion extending radially from the spherical surface of the spherical portion along an imaginary line extending radially from a spherical center of the spherical surface. The above-mentioned fixed member has the plurality of cylinders formed therein in which the plurality of pistons are slidably inserted to reciprocate according to the swinging motion of the spherical portion of the lever. Further, the fixed member has the spherical support portion supporting the spherical portion of the lever and a bearing portion rotatably supporting the rotating member so that the central axis of the rotating member passes the spherical center of the spherical support portion of the fixed member. The rotating member and the shaft portion of the lever are rotatably connected to each other at a position radially separated from the central axis of the rotating member, whereby the rotation of the rotating member orbits the connecting portion of the shaft portion about the central axis of the rotating member, that is, the shaft portion of the lever revolves by the rotation of the rotating member.

The connecting portion between the rotating member and the shaft portion of the lever is constructed so that the inclination angle of the shaft portion of the lever against the rotation axis of the rotating member can be changed.

By shifting the position of the above-mentioned connecting portion, the inclination angle of the shaft portion of the lever to the rotation axis of the rotating member is changed, whereby strokes in reciprocation of the above-mentioned plurality of pistons are changed.

The lever has a rotation preventing mechanism fixed to the fixed member to prevent the lever from continuously rotating.

Further, the above-mentioned first rotating member has a spherical portion, and a first rotating shaft portion extending radially from a spherical surface of the spherical portion along an imaginary line extending radially from a spherical center of the spherical surface through the spherical surface. The first rotating shaft rotates about the axis of the first rotating shaft portion. The above-mentioned second rotating member has a spherical support portion coupled with the spherical portion of the first rotating member to form a spherical abutment and a second rotating shaft portion having a rotation axis which passes the spherical center of the spherical support portion and inclines against the axis of the first shaft portion. The second rotating member rotates about the axis thereof inclined to the axis of the first rotating member.

A rotation synchronizing mechanism is incorporated between the first and second rotating members to synchronize the rotation of them.

The second rotating member has the above-mentioned plurality of cylinders formed herein which are separate from the rotation axis thereof and in a row in a circumferential direction. The plurality of pistons are slidably inserted in the cylinders to be reciprocatable therein. Openings of the cylinders at a side opposite to the first rotating member are closed at least in part by a member integrated with the spherical support portion of the second rotating member.

The first rotating member is rotatably bound by two positions, a rotation support portion of the first rotating shaft portion and the spherical abutment with the second rotating member. The bearing for rotatably supporting the first rotating shaft portion is shiftable in an axial direction relative to the first rotating shaft portion to be supported thereby, corresponding to a change in a supported portion of the first rotating shaft portion.

Further, by shifting the position of the bearing for supporting the first rotating shaft portion, an inclination angle between the first rotating shaft portion and the second rotating shaft is changed, whereby stroke of reciprocation of each piston linked to the first rotating member is changed relative to the second rotating members.

As mentioned above, the fluid pressure in each cylinder is applied to the first and second members as a thrust load in opposite directions to each other. In the present invention, the first and second members are coupled so as to form the spherical abutment, so that the action force and reaction force of the same quantity are applied to the spherical abutment and the force applied on each of the first and second members in the thrust direction dynamically balances.

Therefore, there is no need to support the large thrust load at the other portion. Further, the first and second members effect only relative swinging motion at the spherical abutment, so that a sliding speed is small, a mechanical friction loss is small although the abutment forms sliding surfaces, and a heat generation amount affecting seizure also is small. As mentioned above, the axial piston machine of a high efficiency and high reliability can be constructed without incorporating any roll bearing therein.

Further, by revolving or orbiting a part of the first member about the axis of the second member at a position separated from the spherical center of the spherical abutment, it is possible to impart swinging motion to the first member without using the swash plate as in the above-mentioned conventional machine.

Further, to revolve or orbit a part of the first rotating member relative to the axis of the second rotating member at a position separated from the spherical center of the spherical abutment means to bind the first rotating shaft portion of the first rotating member to a position eccentric to the second rotating shaft of the second rotating member, so that it is possible to impart relative swinging motion to the flange portion of the first rotating member and the cylinder block of the second rotating member by inclining the first rotating shaft relative to the second rotating shaft.

DESCRIPTION OF EMBODIMENTS OF THE INVENTION

An embodiment of an axial piston machine according to the present invention will be explained hereunder taking an axial piston type liquid pump as an example, referring to FIGS. 1 to 3.

Figure 1:
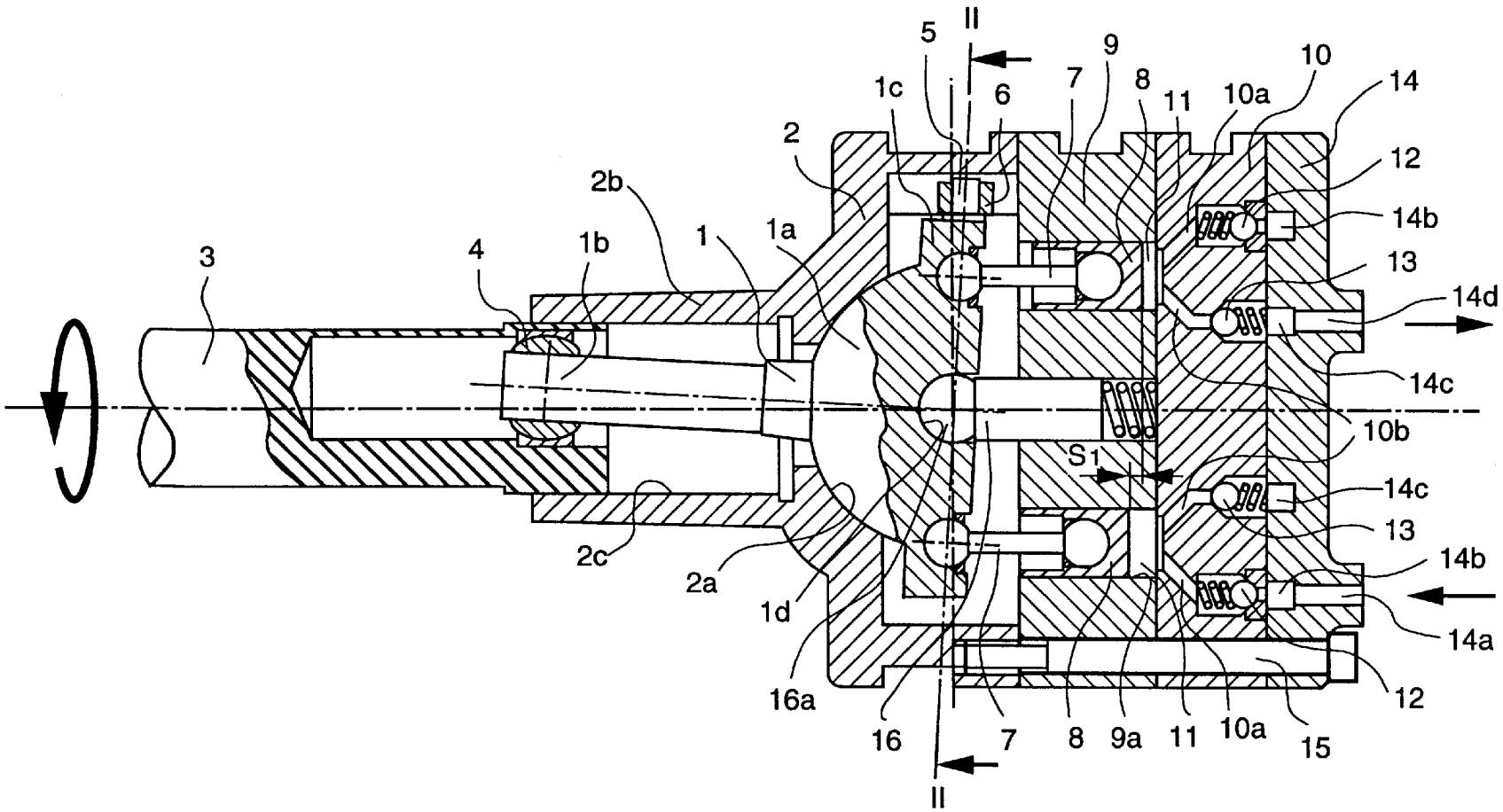
FIG. 1 is a sectional side view of a variable displacement type liquid pump adjusted to be small displacement of a first embodiment of the present invention.

In FIG. 1, the liquid pump comprises a cylinder block 9 provided with a plurality of pistons 8, a lever 1 being swingable and linked to the pistons 8 to reciprocate them and a rotating shaft 3 to swing the lever 1.

The lever 1 has a convex hemispherical portion (hereunder, simply referred to as spherical portion) 1*a* and a shaft portion 1*b* extending from a spherical surface of the spherical portion 1*a* along a radial line extending from a spherical center of the spherical surface through the surface in a radial direction. The cylinder block 9 is covered with a front cover 2 integrated therewith to form a space between the front cover 2 and the cylinder block 9 to accommodate the spherical portion la of the lever 1.

The front cover 2 has a concave hemispherical support portion (hereunder, simply referred to as spherical support portion) 2*a* and a front nose portion 2*b*. The spherical support portion 2*a* forms a spherical coupling with the spherical portion 1*a* of the lever 1 to support it. The front nose portion 2*b* is formed in a shape of cylindrical hollow shaft extending from the spherical support portion 2*a*. The front nose portion 2*b* has a slide bearing portion 2*c* formed in an inner periphery thereof. The slide bearing portion 2*c* rotatably supports the rotating or driving shaft 3 or rotating member.

A central axis of the slide bearing portion 2*c* is on a line passing through a spherical center of the spherical support portion 2*a*. The slide bearing portion 2*c* is made sufficiently long in the axial direction, and it can sufficiently support the driving shaft 3 even if the driving shaft 3 is shifted in the axial direction.

The driving shaft 3 has a cylindrical hole formed in one end portion thereof so that the axis of the hole is eccentric to the rotation axis of the driving shaft 3. The driving shaft 3 rotatably receives a spherical bush 4 in the hole through a spherical bush fixed to the driving shaft 3. The shaft portion 1*b* of the lever 1 is slidably inserted in a through hole formed in the spherical bush 4. The spherical bush 4 allows the shaft portion 1*b* to change an inclination direction while keeping constant an inclination angle between the axis of the shaft portion 1*b* of the lever 1 and the rotation axis of the driving shaft 3.

The shaft portion 1*b* of the lever 1 is made sufficiently long so that a portion of the driving shaft 3 a at which the spherical bush 4 is positioned can axially slide in the front nose portion 2*b*.

The lever 1 has a guide pin 5 one end of which is fixedly inserted in a disc-like flange 1*c* formed in the periphery of the spherical portion 1*a* so that the other end projects radially from the outer periphery of the flange 1*c*. As shown in FIG. 2, the projected end of the guide pin 5 is rotatably inserted in a cylindrical hole formed in a rectangular block 6. The block 6 has 2 parallel side faces 6*a* which are slidably fitted between two parallel faces 2*d* of a guide groove formed in a portion of the front cover 2 opposite to the outer periphery of the flange 1*c* so as to extend in the axial direction as shown in FIG. 1. The guide pin 5, the rectangular block 6 and the guide groove forming portion of the front cover 2 form a rotation preventing mechanism for preventing the lever 1 from rotating about the axis thereof.

A plurality of piston rods 7, each of which has spherical ends, are linked to the flange 1*c* of the lever 1 at positions which are in a row in a circumferential direction and separated from the axis of the shaft portion 1*b* of the lever 1. One spherical end of each piston rod 7 is rotatably linked to a concave spherical portion formed in the flange 1*c*, and the other spherical end is rotatably linked to a concave spherical portion formed in one of the plurality of pistons 8.

The cylinder block 9 is fixed to the front cover 2 so as to close an opening end of the front cover 2, and has a plurality of cylinders 9*a* formed therein. The cylinders 9*a* are arranged circumferentially at positions separated from and in parallel with the axis of the driving shaft 3 or the axis of the sliding bearing portion 2*c* of the front cover 2. The plurality of pistons 8 are slidably inserted in the cylinders 9*a* to form working chambers 11, respectively.

Opening ends of the cylinders 9*a* at the side opposite to the pistons 8 are positioned at the side opposite to the front cover 2, and closed by a cylinder head 10. The working chambers are defined by the cylinders 9*a*, the pistons and the cylinder head 10.

The cylinder head 10 has suction ports 10*a* and delivery ports 10*b* each opened in the openings of the cylinders 9*a*. Suction valves 12 and delivery valves 13 are incorporated in the cylinder head 10 so as to communicate with the suction ports 10*a* and the delivery ports 10*b*, respectively.

A rear cover 14 is arranged on the cylinder head 10 at the side opposite to the cylinder block 9, and has a suction line from a suction port 14*a* to the suction valves 12 through a ling-shaped suction passage groove 14*b*, and a delivery line from the delivery valves 13 to a delivery port 14*d* through a ring-shaped passage groove 14*c*.

The front cover 2, the cylinder block 10, the cylinder head 10 and the rear cover 14 are fastened by fixing bolts 15.

The lever 1 has a concave spherical portion 1*d* formed at a central portion thereof, which portion 1*d* has a common spherical center to the spherical portion 1*a*. The concave spherical portion 1*d* of the lever 1 rotatably receives a convex spherical portion 16 at an end of a pushing rod 16 slidably inserted in a central through hole of the cylinder block 9 and pressed by a compression spring inserted in the central through hole, whereby the convex spherical portion 1*a* of the lever 1 is pressed on the spherical support portion 2*a* of the front cover 2. Thereby, even if pressing force by the liquid pressure in the working chambers 11 is not applied on the lever 1 during stoppage of this liquid pump, the convex spherical portion 1*a* of the lever 1 is always in contact with the spherical support portion 2*a* of the front cover 2 and not separated therefrom.

With the above-mentioned construction of the first embodiment of the present invention, since the spherical center of the spherical portion 1*a* of the lever 1 is a fixed point and the lever 1 is prevented to rotate by the rotation prevention mechanism, when the driving shaft 3 rotates, the spherical bush 4 orbits, that is, the shaft portion 1*b* of the lever 1 revolves about the fixed point, whereby the flange 1*c* of the lever 1 is swung by the revolution of the shaft portion 1*b* in a manner that a swinging plate in a conventional swash plate type liquid pump swings. The swinging motion of the flange 1*c* of the lever 1 reciprocates the pistons 8 through the piston rods 7 to pressurize a working fluid and transport it.

In this case, the pressure in the working chambers 11 is applied on the lever 1 through the pistons 8 and the piston rods 7, and the reaction is applied on the spherical portion 1*a* of the lever 1 by the spherical support portion 2*a*, so that the force in the thrust direction is balanced without providing any other thrust bearing.

On the other hand, the pressure in the working chambers 11 also is applied, through the cylinder head 10 closing one end of each working chamber 11, on the front cover 2, the cylinder block 9, the cylinder head 10 and the rear cover 14 which are integrated as one block by the fixing bolts. However, the reaction from the spherical convex portion 1*a* of the lever 1 is applied on the spherical support portion 2*a*, so that the force in the thrust direction is balanced without providing any other thrust bearing.

A relatively large load is applied between the spherical portion 1*a* and the spherical support portion 2*a*. However, the relative motion between the spherical portion 1*a* and the spherical support portion 2*a* is swinging motion of which a swinging angle is small, so that a sliding speed is small and a heat generation amount affecting a mechanical friction loss and seizure becomes small, whereby a liquid pump of a high efficiency and high reliability can be constructed.

Further, since the liquid pump has no thrust supporting portion other than the spherical support portions, there is no need to use roll bearings and the liquid pump can be low in cost and long in life. Further, the cost can be reduced because the swash plate required in the conventional swash plate type liquid pump is not necessary.

Figure 3:
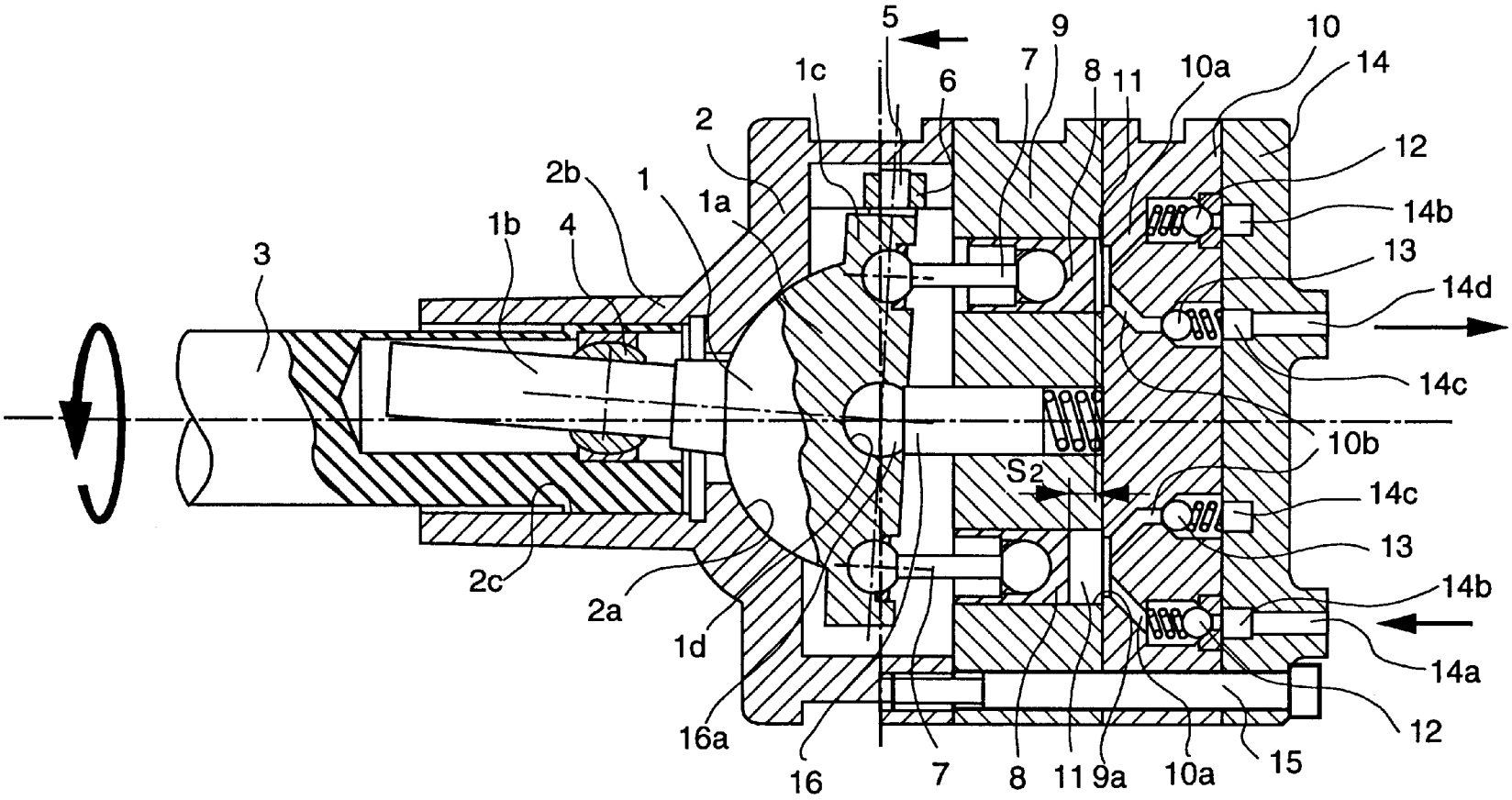
FIG. 3 is a sectional side view of the variable displacement type liquid pump adjusted to be large displacement of the first embodiment.

As is apparent by comparing FIG. 1 and FIG. 3, in the present embodiment, axial shift of the driving shaft 3 shifts axially the position of the spherical bush 4 which is a connecting portion between the shaft portion 1*b* of the lever 1 and the driving shaft 3, whereby an inclination angle of the shaft portion 1*b* against the rotation axis of the driving shaft 3 can be changed to change a swinging angle of the flange 1*c* of the lever 1.

Thereby, the piston stroke increases from S1 shown in FIG. 1 to S2 shown in FIG. 3. Although in the conventional swash plate type liquid pump, the piston stroke was fixed by an inclination angle of the swash plate, the present embodiment can provide the pump with a variable displacement function or displacement controlling function which adjusts a discharge flow rate of the pump by changing the piston stroke when required.

In the above-mentioned first embodiment of the invention, the pistons 8 are connected to the flange 1*c* of the lever 1, however, it is not necessarily restricted to this construction in practice. For example, by making the end face of the flange 1*c* into a flat smooth surface, forming the shape of the piston as the piston of the swash plate type piston pump disclosed in the above-mentioned MECHANICAL ENGINEER'S HANDBOOK B5 FLUID MACHINERY page 190 FIG. 437, and incorporating therebetween a piston shoe as in the swash plate type piston pump, it is possible to reciprocate the piston by the swinging motion of the flange. In any way, it is necessary to link the movement of the flange 1*c* at a position separated radially from the central axis of the spherical portion 1*a* of the lever 1 with the movement of the pistons.

Further, in a case where the liquid pump employs the above-mentioned piston shoes, even if the flange 1*c* gradually rotates to deviate in the circumferential direction, the pump can operate normally, so that the first embodiment of the present invention can be put into practice without a rotation preventing mechanism as mentioned above.

The first and second members defined as constructional parts of the present invention correspond to as follows in this embodiment, for example. That is, the first member is the lever 1, and the second member is the cylinder block 9, front cover 2, cylinder head 10 and rear cover 14. The driving shaft 3 eccentrically receiving the shaft portion 1*b* of the lever 1 and revolving the shaft portion 1*b* formes a swinging mechanism for swinging the lever 1 relative to the cylinder block 9.

Figure 5:
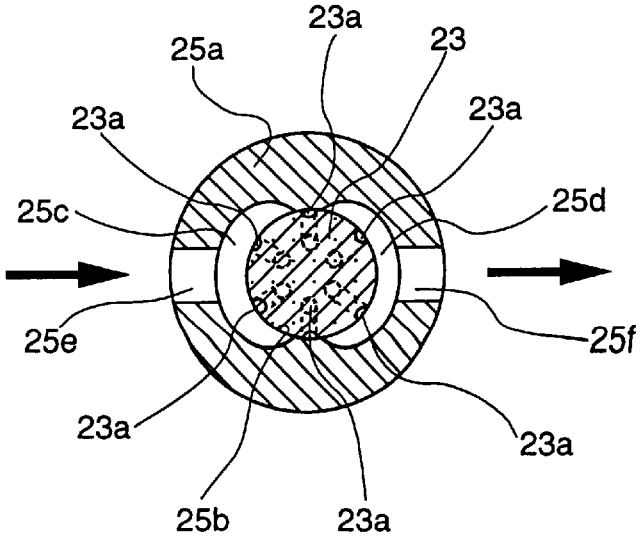
FIG. 5 is a sectional view of a part of the variable displacement type liquid pump of FIG. 4, taken along a line V—V.
Figure 4:
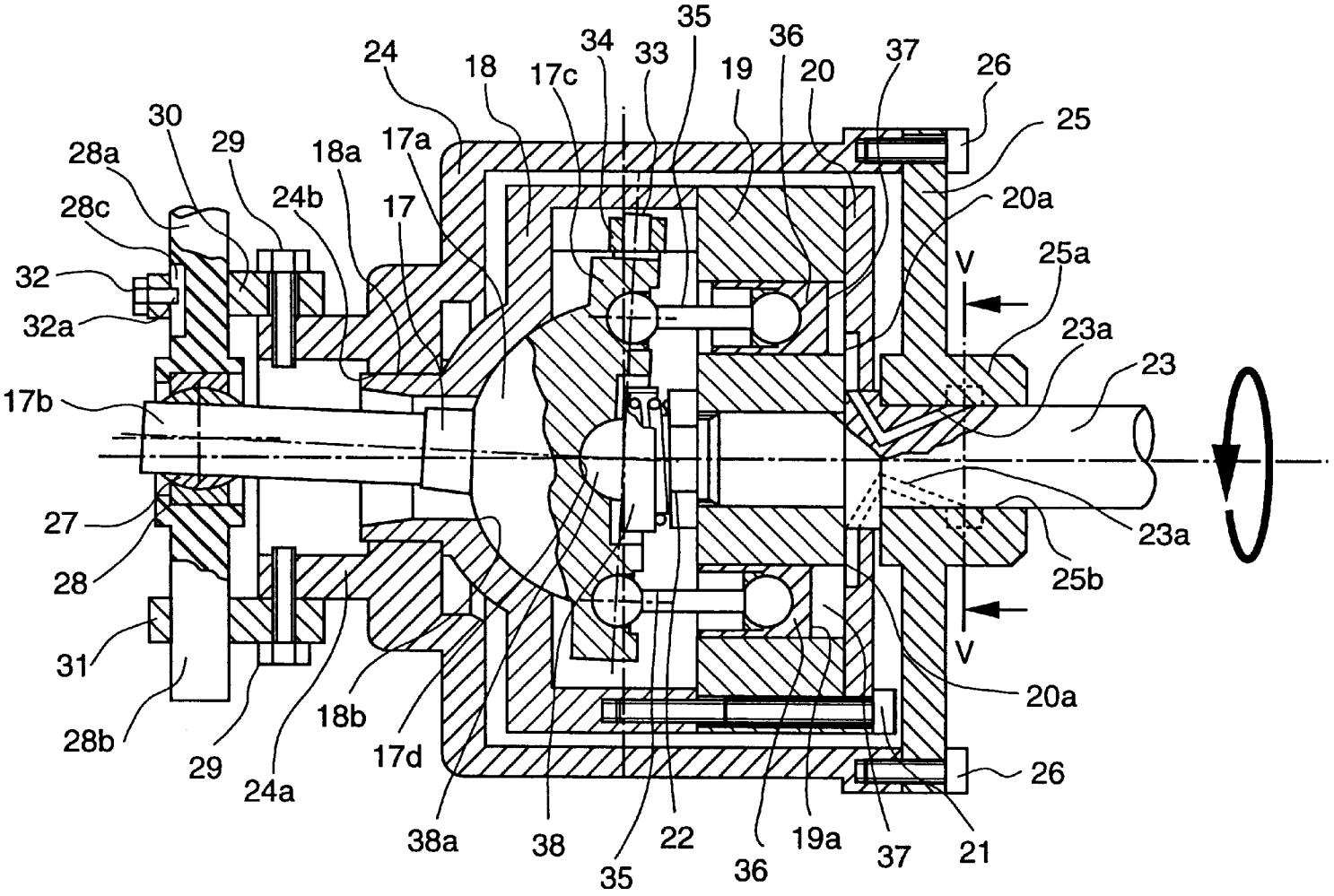
FIG. 4 is a sectional side view of a variable displacement type liquid pump adjusted to be small displacement of a second embodiment of the present invention.
Figure 6:
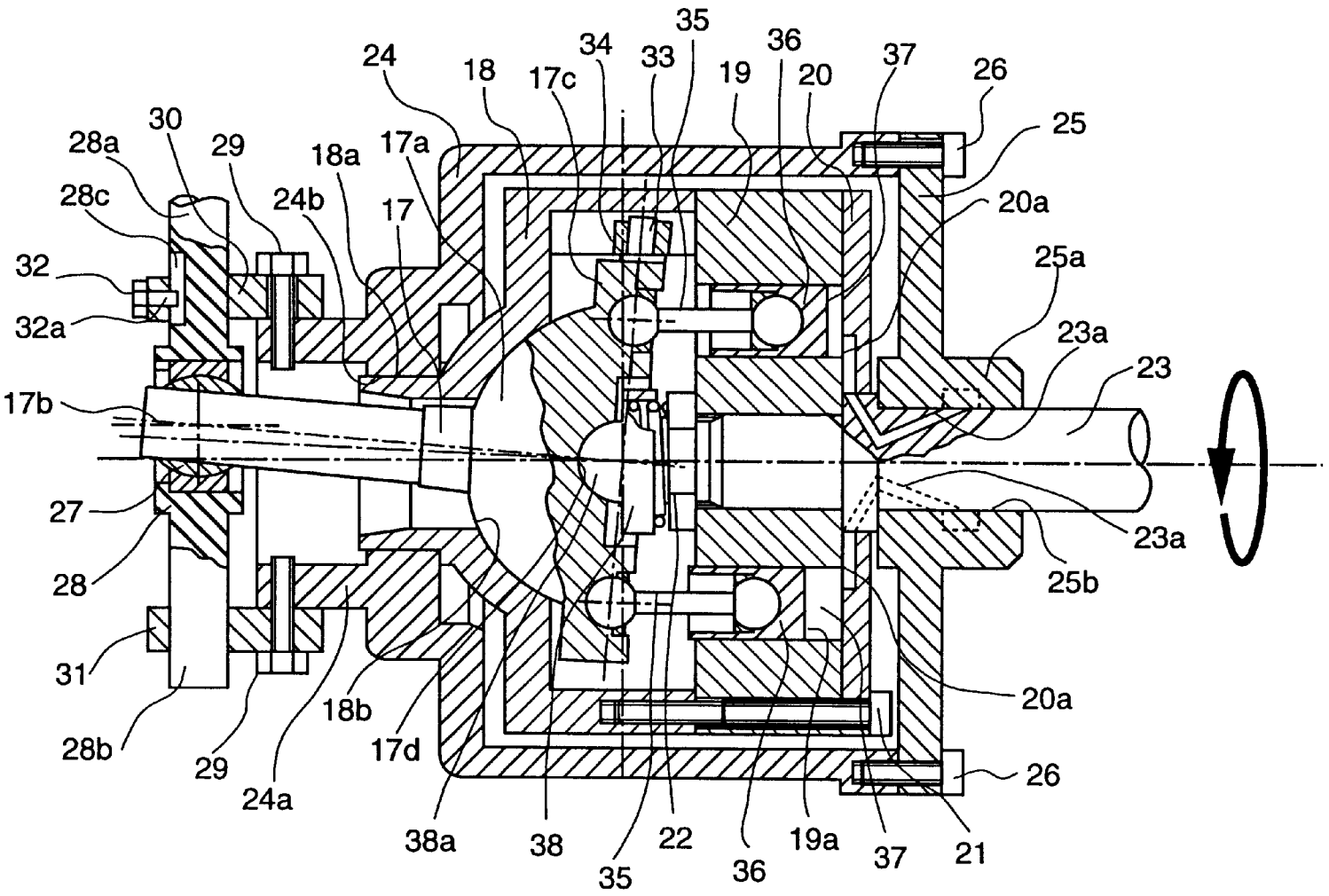
FIG. 6 is a sectional side view of the variable displacement type liquid pump adjusted to be large displacement of the second embodiment.

Referring to FIGS. 4 to 6, a second embodiment of the axial piston machine of the present invention will be explained hereunder, taking an example of an axial piston type liquid pump.

As shown in FIGS. 4 and 6, a lever 17 as a first rotating member has a convex semispherical portion 17*a* (hereunder, simply referred to as a spherical portion) and a shaft portion 17*b* extending radially from the spherical center of the spherical portion 17*a*. The lever 17 is rotatably supported as described later.

A front cover 18 and cylinder block 19 and cylinder head 20 are fixed to each other by fixing bolts 21 arranged in the outer peripheral portions of them and construct a second rotating member together with a driving shaft 23 fixed to a central portion of the cylinder block 19 by a nut 22.

The second rotating member is rotatably supported, at two portions thereof one of which is a projected outer cylindrical surface portion 18*a* of a central end portion of the front cover 18 and the other is the driving shaft 23, on an inner slide bearing portion 24*b* of a front nose portion 24*a* of a front housing 24 and an inner peripheral slide bearing portion 25*b* of a rear nose 25*a* of a rear housing 25.

The front housing 24 and the rear housing 25 are fixed by a plurality of bolts 26 to form a housing.

A mechanism for rotatably supporting an end portion a of the shaft portion 17*b* of the lever 17 and adjusting an inclination angle of the shaft portion 17*b* is provided. In the mechanism, a spherical bush 27 slidably inserting the shaft portion 17*b* is rotatably inserted in a slide member 28. Shaft portions 28*a*, 28*b* of the slide member 28 are slidably supported by a first guide member 30 and a second guide member 31, respectively. The first and second guide members 30, 31 are fixed to the front nose portion 24*a* of the front housing 24.

The first guide member 30 has a special screw 32 fixed thereto. The screw 32 has a pin portion 32*a* at an end portion thereof. The pin portion 32*a* is inserted in a key groove 28*c* formed in the shaft portion 28*a* of the slide member 28 to prevent the slide member 28 from rotating about the axes of the shaft portions 28*a*, 28*b*. The spherical bush 27 is adjustably supported so that the position is changed in a radial direction of the shaft portion 17*b*.

The spherical portion 17*a* of the lever 17 which is the first rotating member is rotatably supported on a spherical support portion 18*b* of the front cover 18 which is a part of the second rotating member, the shaft portion 17*b* is rotatably supported by the spherical bush 27 as mentioned above. Since the spherical bush 27 is disposed at a position separated from the rotation axis of the second rotating member, the rotation axis of the first rotating member and the rotation axis of the second rotating member are inclined to each other.

A guide pin 33 is fixed to the lever 17 so as to project radially from an outer periphery of a disc-like flange portion 17*c* formed adjacently to the spherical portion 17*a*. The guide pin 33 is rotatably inserted in a cylindrical through hole of a rectangular block 34. The block 34 has a pair of parallel side faces slidably inserted between a pair of parallel plane portions of a guide groove formed in a part of an inner peripheral portion of the front cover 18 as in the first embodiment. Thereby, a rotation synchronizing mechanism for the first and second rotating members is constructed.

Figure 2:
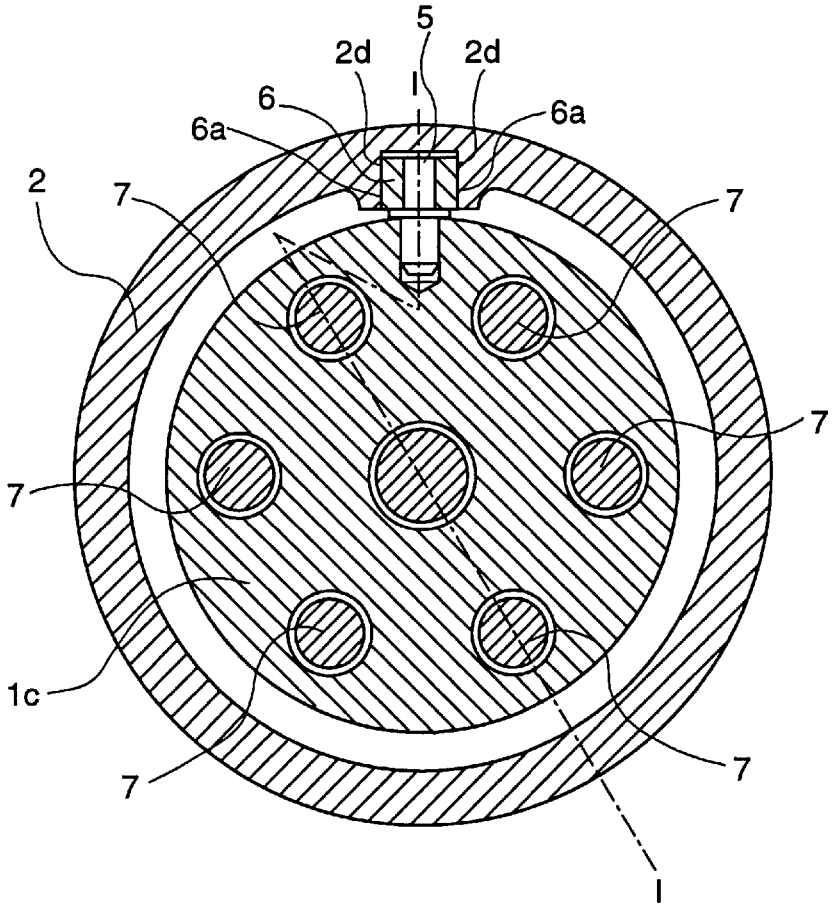
FIG. 2 is a sectional view of the variable displacement type liquid pump of FIG. 1, taken along a line II—II.

The rotation synchronizing mechanism is a similar construction to one as shown in FIG. 2.

A plurality of piston rods 35 each having spherical ends are mounted on the flange portion 17*c* of the lever 17 at positions separated radially from the central axis of the shaft portion 17*b* and in a row in the circumferential direction. The one end of each piston rod 35 is rotatably supported on the flange portion 17*c* of the lever 17, and the other end of the rod 35 is rotatably mounted on the piston 36.

The cylinder block 19 has a plurality of cylinders 19*a* formed axially therein at positions radially separated from the rotation axis thereof and in a row in the circumferential direction. The pistons 36 are slidably o inserted in the cylinders 19*a*, respectively.

An opening end of each cylinder 19*a* is closed by the cylinder head 20, and the cylinders 19*a*, the pistons 36 and the cylinder head 20 define a plurality of working chambers 37.

In the cylinder head 20, a plurality of radial communication grooves 20*a* are formed at an end face of the cylinder head 20 so as to extend from the opening portions of the cylinders 19*a* to the outer periphery of the driving shaft 23. A plurality of communication holes 23*a* are formed in the driving shaft 23, which holes 23*a* communicate the communication grooves 20*a* and the slide bearing portion 25*b* of the rear housing 25. In the slide bearing portion 25*b* of the rear housing 25, a suction groove 25*c* and a delivery groove 25*d* are formed at an axial position at which one end of each communication hole 23*a* is opened, as shown in FIG. 5. The suction groove 25*c* communicates with a suction port 25*e* and the delivery groove 25*d* communicates with a delivery port 25*f*.

The lever has a concave spherical portion 17*d* formed in the center of the flange portion 17*c* of the lever 17 and the concave spherical portion 17*d* has a common spherical center to the spherical portion 17*a*. A spherical end portion 38*a* of a bush member 38 is fitted in the concave spherical portion 17*d* to press the spherical portion 17*a* of the lever 17 on the spherical support portion 18*b* of the front cover 18, whereby a tight contact between the spherical support portion 18*b* and the spherical portion 17*a* can be always kept.

With the above-mentioned construction of the second embodiment, when the driving shaft 23 is driven to rotate in an arrow direction shown in FIGS. 4 and 6, the front cover 18, the cylinder block 19 and the cylinder head 20, which are the second rotating member, rotate and then the lever 17 of the first rotating member is rotated, synchronizing with the second rotating member by the rotation synchronizing mechanism.

Since the rotation axis of the first rotating member and the rotation axis of the second rotating member are inclined to each other, the pistons 36 linked to the flange 17*c* of the lever 17 through the piston rods 35 reciprocate in the cylinders 19*a* while rotating together with the cylinder block 19.

The working chambers 37 defined by the pistons 36, etc. expand in volume when passing at a lower side of the sectional view in FIGS. 4 and 6 and decrease in volume when passing at an upper side of the sectional view. Since the openings of the communication holes 23*a* communicating with the working chambers 37 through the communication grooves 20*a* communicates with the suction groove 25*c* while the volumes of the working chambers are increasing (at the lower side of the sectional view in FIG. 4), the working fluid flows from the suction port 25*e* into the working chambers 37, and since while the working chambers 37 are decreasing in volume (at the upper side in FIG. 4), the openings of the communication holes 23*a* are in communication with the delivery groove 25*d*, the working fluid is discharged from the discharge port 25*f*, whereby a function of pump is carried out.

In FIGS. 4 and 6, a driving shaft for rotating the first and second rotating members is the driving shaft 23, however, it can be the shaft portion 17*b* of the lever 17.

In those cases, the pressure in the working chambers 37 is applied on the lever 17 through the pistons 36 and the piston rods 35, however, the reaction force is applied on the spherical portion 17*a* of the lever 17 from the spherical support portion 18*b* of the front cover 18, so that the force in the thrust direction balances without any other thrust support portion.

On the other hand, the pressure in the working chambers 37 also is applied on the front cover 18, the cylinder block 19, the cylinder head 20 and the driving shaft 23 which are fixed to each other and integrated as one block, through the cylinder head 20 closing the one end of each working chamber 37. However, the reaction force from the spherical portion 17*a* of the lever 17 is applied on the spherical support portion 18*b* of the front cover 18, so that the force in the thrust direction balances without any other thrust support portion.

A relatively large load is applied between the spherical portion 17*a* and the spherical support portion 18*b*. However, the relative motion between the spherical portion 17*a* and the spherical support portion 18*b* is swinging motion of which the swinging angle is small, so that a sliding speed is small and a heat generation amount affecting a mechanical friction loss and seizure becomes small, whereby a liquid pump of a high efficiency and high reliability can be constructed.

Further, since the liquid pump has no thrust supporting portion other than the spherical support portions, there is no need to use roll bearings and the pump can be low in cost and long in life.

As is apparent by comparing FIG. 4 and FIG. 6, in the present embodiment, radial shift of the sliding member 28 shifts the position of the spherical bush 27 which is a connecting portion between the shaft portion 17*b* of the lever 17 and the sliding member 28, whereby the inclination angle between the shaft portion of the first rotating member and the rotation axis of the second rotating member can be changed. Therefore, the present embodiment also can provide the pump with a variable displacement function or displacement controlling function which adjusts a delivery flow rate of the pump by changing the piston stroke when required.

As is explained above, the second embodiment is concerned with a liquid pump having a pumping function, however, it is possible to provide it with a function of liquid motor.

That is, by communicating the suction groove 25*c* as a liquid supply groove with a supply port for a pressurized fluid instead of the suction port 25*e*, and communicating the delivery groove 25*d* as a liquid discharge groove with a discharge port for the fluid reduced in pressure instead of the delivery port 25*f*, the pressurized fluid flows in the working chambers 37 at the position where the working chambers 37 are communicating with the pressurized fluid (at the lower side of the sectional view in FIGS. 4, 6; left half of FIG. 5) to expand the working chambers 37, so that the pistons 36 are pressed to move, thereby to rotate the driving shaft 23 as an output shaft in the arrow direction, as shown in FIGS. 4 and 6.

At this time, the working chambers 37 are reduced in volume at the position where the working chambers 37 are in communication with the pressurized fluid (at the upper side of the sectional view of FIGS. 4, 6; right half of FIG. 5), so that the pistons 36 press the fluid reduced in pressure out of the chambers. Since the working energy obtained by pressing the pistons 36 with the pressurized fluid is larger than the working energy obtained by pressing the fluid reduced in pressure by the pistons 36, power corresponding to the difference in working energy can be put out from the output shaft of the driving shaft 23. The output shaft can be the shaft portion 17*b* of the lever 17.

In this manner, in a case where the present invention is applied to the liquid motor, also, a heat generation amount affecting a mechanical friction loss and seizure is small, a machine of a high efficiency and high reliability can be realized, and a low cost and long life can be realized because it has no rotation support portion to which a relatively large thrust load is applied and no need to use roll bearings, which is the same as the second embodiment.

Further, it is possible to add a function of adjusting an output of the liquid motor by changing the piston stroke when required, which also is the same as the second embodiment.

In the axial piston machine such as a liquid pump pressurizing fluid and transporting it by axial reciprocation of pistons, a liquid motor taking out an output, using a pressurized liquid, according to the present invention,, a mechanical friction loss and friction heat generation due to a relatively large load in the thrust direction can be reduced and the use of parts such as thrust roll bearings can be avoided, so that axial piston machines of a high efficiency, high reliability and long life can be provided at a low cost. Further, it is easy to provide the machines with a function such as displacement control, etc.

What is claimed is:

1. An axial piston machine comprising first and second members arranged so that said first and second members are relatively swingable to provide relative swinging motion, said second member having a cylinder-forming portion, a plurality of pistons inserted in a plurality of respective cylinders formed in said second member, said pistons being engaged with said first member so that the relative swinging motion reciprocates said plurality of pistons in said cylinders, and a swinging mechanism for swinging said first and second members relative to the other, wherein said first and second members have a coupling portion binding one of said first and second members to a point of the other to be universally rotatable about said point, said swinging mechanism comprises a relative revolving mechanism for revolving at least one of said first and second members to provide the relative swinging motion between said first and second members, thereby to reciprocate said pistons, and a position at which said at least one of said first and second members is rotatably drivable is spaced from the point outside of said coupling portion.

2. An axial piston machine according to claim 1, wherein said first and second members have a spherical portion and a respective spherical support portion to provide a spherical abutment along which said first and second members are relatively slidable to each other, said second member supporting a reaction force applied on said first member by said pistons.

3. An axial piston machine according to claim 2, wherein said first member comprises said spherical portion, a shaft portion radially extending from a spherical surface of said spherical portion in a direction passing and opposite to a spherical center of said spherical surface and a piston engaging portion at an opposite side to said spherical surface, and said relative revolving mechanism revolves said shaft portion of said first member to provide revolving motion for swinging said piston engaging portion of said first member relative to said second member.

4. An axial piston machine according to claim 3, wherein said revolving mechanism comprises a rotating shaft engaged with said shaft portion of said first member so that a rotation axis of said rotating shaft is eccentric to an axis of said shaft portion of said first member, whereby rotation of said rotating shaft revolves the engaged portion of said shaft portion of said first member.

5. An axial piston machine according to claim 4, wherein said rotating shaft has a hollow cylindrical portion at one end thereof, said hollow cylindrical portion being rotatably and slidably supporting said rotating shaft, and said engaged portion being adjustable by relative axial shift of said rotating shaft to said shaft portion of said first member.

6. An axial piston machine according to claim 2, wherein said first member comprises said spherical portion, a shaft portion radially extending from a spherical surface of said spherical portion in a direction passing and opposite to a spherical center of said spherical surface and a piston engaging portion at an opposite side to said spherical surface, and said relative revolving mechanism comprises a rotating device for rotating said first and second members about respective axes thereof at an inclination angle between the axes of said first and second members, and a guide member rotatably supporting said shaft portion of said first member to keep the inclination angle constant, whereby said piston engaging portion swings relative to said second member.

7. An axial piston machine according to claim 6, wherein said rotating device is a rotating shaft fixedly connected to one of said first and second members for rotating said first and second members, and said guide member is adjustable in a radial direction of said shaft portion of said first member, whereby said inclination angle between said first and second members is changeable.

8. An axial piston machine comprising:

a lever having an axis, said lever including a spherical portion having a spherical surface of which a spherical center is on an axis of said lever and a shaft portion axially extending from said spherical surface in a direction opposite to said spherical center;

a plurality of pistons each linked with said lever at an opposite side to said spherical surface of said lever;

a fixed member having an axis and comprising a plurality of cylinders formed therein and separated from the axis and from each other, a spherical support portion slidably supporting said spherical portion of said lever, and a bearing portion surrounding said shaft portion of said lever, said plurality of pistons being slidably inserted in said cylinders, respectively; and a rotating member, rotatably inserted in said bearing portion of said fixed member, and slidably and rotatable engaged with said shaft portion of said lever so that a rotation axis of said rotating member is eccentric to the axis of said shaft portion of said lever, whereby rotation of said rotating member causes swinging motion of said spherical portion relative to said fixed member and the swinging motion of said spherical portion of said lever reciprocates said pistons.

9. An axial piston machine according to claim 8, wherein said rotating member is a rotating shaft, and said rotating shaft is slidable to change a distance between said spherical center and an engaging portion of said rotating shaft with said shaft portion of said lever, whereby an inclination angle between the axes of said lever and said fixed member is changed, thereby changing strokes of said pistons.

10. An axial piston machine according to claim 8, wherein a rotation preventing mechanism is provided for preventing said lever from rotating about the axis thereof.

11. An axial piston machine comprising:

first and second rotating members being rotatable about inclined axes, said second rotating member having a plurality of spaced cylinders formed therein parallel to and separated from the axis thereof;

a plurality of pistons inserted in said cylinders, respectively, and mechanically linked to said first rotating member;

a mechanism for relatively swinging said first and second rotating members so as to reciprocate said plurality of pistons in said cylinders; and wherein said first and second rotating members each have a spherical portion to provide a spherical abutment along which said first and second rotating members are relatively slidable, each spherical portion having a spherical center on a cross point of the axes of said first and second rotating members, said second rotating member supporting said first rotating member in a direction of the axis of said second member, and said mechanism for generating a relative swinging motion comprises a rotation input shaft for rotating said first and second rotating members about the axes thereof, and a fixed member for rotatably supporting said first rotating member so as to keep an inclination angle constant while allowing said first rotating member to rotate, whereby said first rotating member slides on said second rotating member along said spherical abutment and swings relatively to said second rotating member.

12. An axial piston machine according to claim 11, wherein a rotation synchronizing mechanism is provided for synchronizing the rotation of said first and second rotating members.

13. An axial piston machine according to claim 11, wherein said cylinders are spaced circumferentially in a row, and said cylinders define working chambers with said pistons and a member integrated with said spherical portion of said second rotating member, respectively.

14. An axial piston machine according to claim 11, wherein said first rotating member has a shaft portion separated axially from said spherical portion and is supported at two portions of the spherical abutment and the shaft portion rotatably supported by said fixed member.

15. An axial piston machine according to claim 14, wherein said fixed member rotatably supporting said shaft portion of said first rotating member is adjustable in a perpendicular direction to the axis of said second rotating member so that said inclination angle is changed for changing piston strokes.

16. An axial piston machine according to claim 1, wherein said cylinder forming portion of said second member is a cylinder block portion, and spaced from and opposite to said coupling portion of said second member.

* * * * *